US011091294B2

(12) United States Patent
Bianco

(10) Patent No.: US 11,091,294 B2
(45) Date of Patent: Aug. 17, 2021

(54) CONTAINER FOR SAUCE PACKAGING

(71) Applicant: PASTIFICIO RANA S.p.A., San Giovanni Lupatoto (IT)

(72) Inventor: Massimiliano Bianco, San Giovanni Lupatoto (IT)

(73) Assignee: PASTIFICIO RANA S.p.A.

( * ) Notice: Subject to any disclaimer, the term of this patent is extended or adjusted under 35 U.S.C. 154(b) by 34 days.

(21) Appl. No.: 16/408,958

(22) Filed: May 10, 2019

(65) Prior Publication Data

US 2020/0247582 A1 Aug. 6, 2020

(30) Foreign Application Priority Data

Jan. 31, 2019 (IT) ..... 102019000001393

(51) Int. Cl.

| | |
|---|---|
| ***B65D 21/02*** | (2006.01) |
| ***B65D 1/26*** | (2006.01) |
| ***B65D 43/02*** | (2006.01) |
| ***B65D 53/08*** | (2006.01) |
| ***B65D 85/72*** | (2006.01) |

(52) U.S. Cl.

CPC ..... *B65D 21/0233* (2013.01); *B65D 1/26* (2013.01); *B65D 43/0231* (2013.01); *B65D 53/08* (2013.01); *B65D 85/72* (2013.01); *B65D 2543/00092* (2013.01)

(58) Field of Classification Search

CPC B65D 21/0233; B65D 43/0231; B65D 85/72; B65D 53/08

USPC ..... 220/288, 656, 657

See application file for complete search history.

(56) References Cited

U.S. PATENT DOCUMENTS

| | | | | |
|---|---|---|---|---|
| 3,128,005 | A * | 4/1964 | Sherlock | B65D 1/26 220/288 |
| 6,044,994 | A * | 4/2000 | Miller | B65D 41/045 215/341 |
| 2014/0042158 | A1* | 2/2014 | Witkowski | B65D 43/0212 220/4.01 |
| 2015/0321796 | A1* | 11/2015 | O'Leary | B65D 21/0233 220/675 |
| 2018/0009101 | A1* | 1/2018 | Piccininni | B62B 3/16 |
| 2019/0059321 | A1* | 2/2019 | Casale | B65D 43/165 |

* cited by examiner

*Primary Examiner* — Don M Anderson
(74) *Attorney, Agent, or Firm* — The Belles Group, P.C.

(57) ABSTRACT

A container for sauce packaging extends along an axis and comprises a side wall, a bottom wall connected to one end of the side wall to define a containment compartment; a top wall configured for allowing the adhesion of a protective foil to seal the container; and an outer cylindrical wall that extends around the side wall and is configured to be coupled to a lid; wherein the side wall comprises a lower portion flared and connected to the bottom wall, and an upper portion connected to the outer cylindrical wall through the top wall.

16 Claims, 3 Drawing Sheets

CONTAINER FOR SAUCE PACKAGING

CROSS REFERENCE TO RELATED APPLICATIONS

This Patent Application claims priority from Italian Patent Application No. 102019000001393 filed on Jan. 31, 2019, the entire disclosure of which is incorporated herein by reference.

TECHNICAL FIELD

The present invention relates to a container, in particular a container for sauce packaging.

BACKGROUND

In general, a container for sauce packaging comprises a side wall, and a bottom wall connected to one end of the side wall. Generally, the side wall and the bottom wall are made of plastic material.

In the industrial process of sauce packaging, containers for sauces are generally stacked in order to save space.

As is known, when at least two containers are stacked, it is difficult to separate the single container from the stack of containers, especially if the separation operation is carried out by a machine, such as an automatic machine or a robotic manipulator.

Sometimes, the containers for sauce packaging can be resealable by means of a lid configured to be coupled with the side wall, which must have a shape and a stiffness suitable to allow a coupling with the lid.

In addition, food regulation requires the container to be sealed with a protective foil to preserve the contents and ensure hygienic and health safety.

This additional need requires the mouth of the container to be shaped in such a way as to allow the protective foil to be easily applied by means of special machinery.

Known containers cannot easily and economically meet the above requirements.

BRIEF SUMMARY

The object of the present invention is to provide a container for sauce packaging that is simple and economical to make and particularly suitable for industrial packaging processes.

In accordance with the present invention there is provided a container for sauce packaging, extending along an axis and comprising a side wall, a bottom wall connected to one end of the side wall to define a containment compartment; a top wall configured for allowing the adhesion of a protective foil to seal the container; and an outer cylindrical wall that extends around the side wall and is configured to be coupled to a lid; the side wall comprises a lower portion, flared and connected to the bottom wall, and an upper portion connected to the outer cylindrical wall through the top wall.

In accordance with the present invention it is possible to dimension the bottom wall, the side wall, the top wall, and the outer cylindrical wall independently from each other according to the specific functions of each of them.

The container in accordance with the present invention allows the stacking of a plurality of containers avoiding contact between the side walls lower portions of the plurality of stacked containers.

In other words, the side walls lower portions of the plurality of containers are spaced apart from each other.

In particular, the outer cylindrical wall is so high that the inclined side walls of two stacked containers do not touch each other.

In this way, avoiding contact between the lower portions of the plurality of containers, the separation operation of a single container from the stack of the plurality of containers is particularly easy.

The separation operation of a container from the stack of the plurality of containers, during a phase of an industrial process, which comprises, for example, the preparation of a sauce, is carried out by a machine, such as an automatic machine or a robotic manipulator, which does not provide the same manual skills and cognitive capacity of a human operator. Therefore, it is particularly important for the efficiency of the industrial process that the separation operation is easy and repeatable.

In particular, the container has a gap between the outer cylindrical wall and the side wall.

In this way it is possible to shape the outer cylindrical wall and the upper portion of the side wall according to their respective functions and define the thickness of the same independently from the extension of the top wall.

In particular, in accordance with a preferred embodiment, the upper portion is flared and constitutes the extension of the lower portion.

In this way, the upper portion constitutes an extension of the lower portion, making it easy to manufacture the container, for example by means of injection moulding.

In accordance with a further embodiment, the upper portion is cylindrical in shape.

Thanks to the cylindrical shape of the upper portion, the coupling between the upper portion and the outer cylindrical wall is easy, since the upper portion and the outer cylindrical wall have the same shape.

According to a preferred embodiment, the container comprises a shoulder between the upper and lower portion.

Thanks to the present invention, the shoulder defines a supporting area between the upper portions of the plurality of stacked containers.

In particular, the container comprises a plurality of connecting elements between the upper portion of the side wall and the outer cylindrical wall.

In this way, the plurality of connecting elements has the function of stiffening the upper portion of the container and, in particular, the outer cylindrical wall, the upper portion of the side wall and the top wall, allowing to limit the thickness, save material and define an adequate stiffness.

In particular, the connecting elements are evenly distributed around the axis between the outer cylindrical wall and the upper portion of the side wall.

In this way, the stiffness of the outer cylindrical wall remains substantially constant.

In particular, each connecting element extends to the lower end of the outer cylindrical wall.

In this configuration, each connecting element defines an additional supporting surface between the plurality of stacked containers, making the stack stable for the plurality of containers and preventing contact between the side walls.

In particular, the outer cylindrical wall has an outer face and comprises a thread along the outer face for coupling with a lid for closing the container.

Thanks to the thread, the container can be closed with a screw lid.

According to a preferred embodiment, the thread is configured to allow the closure of the container by means of a 90° rotation maximum screwing of a lid.

Thanks to the present invention, the container can be closed quickly and easily with a screw lid.

In particular, in a phase of an industrial process, such as sauce packaging, the lid screwing operation is carried out by a machine, such as an automatic machine or a robotic manipulator. It is therefore particularly important for the efficiency of the industrial process that the screwing operation is carried out quickly and easily.

In particular, the top wall has a flat top face.

In this way, the application of a protective foil to preserve and/or store the contents of the container for a long time is particularly easy.

In particular, the minimum distance between the side wall and the outer cylindrical wall is at least 3 mm.

In this way, the top wall has a large surface that facilitates the industrial operations of applying a protective foil.

In greater detail, the extension of the area of the upper surface is sufficient to allow the simple and stable application of a protective foil by means of a machine, such as an automatic machine or a robotic manipulator.

According to a preferred embodiment the bottom wall, the outer cylindrical wall, the top wall, the lower portion, and the upper portion are made of plastic material and, in particular, the container is made by injection moulding.

Thanks to the plastic material, the container is light and can be manufactured, preferably by injection moulding, in a simple and economic way.

Another purpose of the present invention is to provide a container assembly.

In accordance with the present invention, a container assembly is manufactured comprising the container and a lid coupled to the outer cylindrical wall to close the container.

Thanks to the lid, the container can be securely re-closed after partial use of the contents.

According to a preferred embodiment, the container assembly comprises a protective foil adhesively bonded to the top wall.

Thanks to the protective foil, the container assembly is able to preserve and/or store the contents of the container assembly for a long period of time.

BRIEF DESCRIPTION OF THE DRAWINGS

Other characteristics and advantages of the present invention will become clear from the following description of two non-limiting embodiments thereof, with reference to the figures attached hereto, in which.

DETAILED DESCRIPTION

Figure 1:
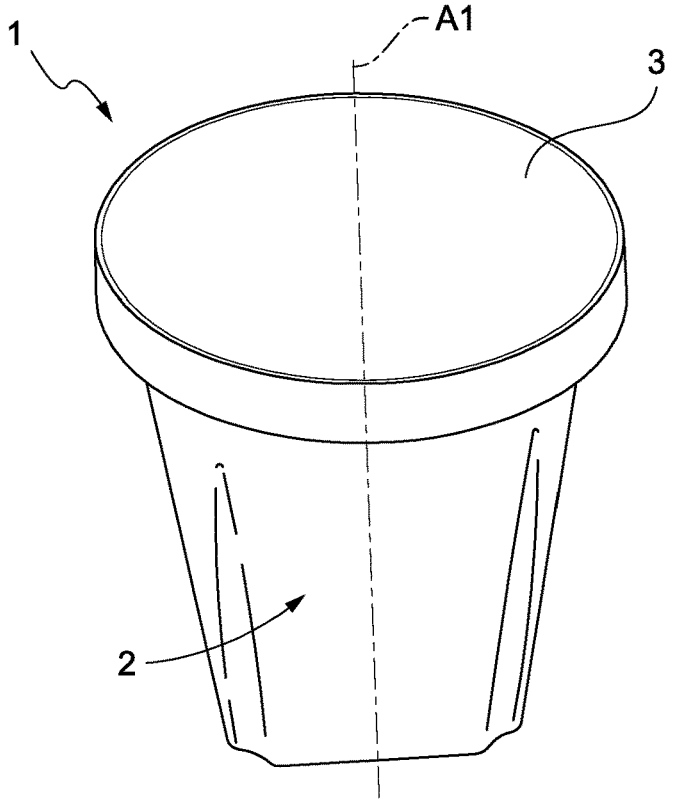
FIGS. 1 and 2 are perspective views, with parts removed for clarity, of a container assembly for sauce packaging in accordance with the present invention.
Figure 2:
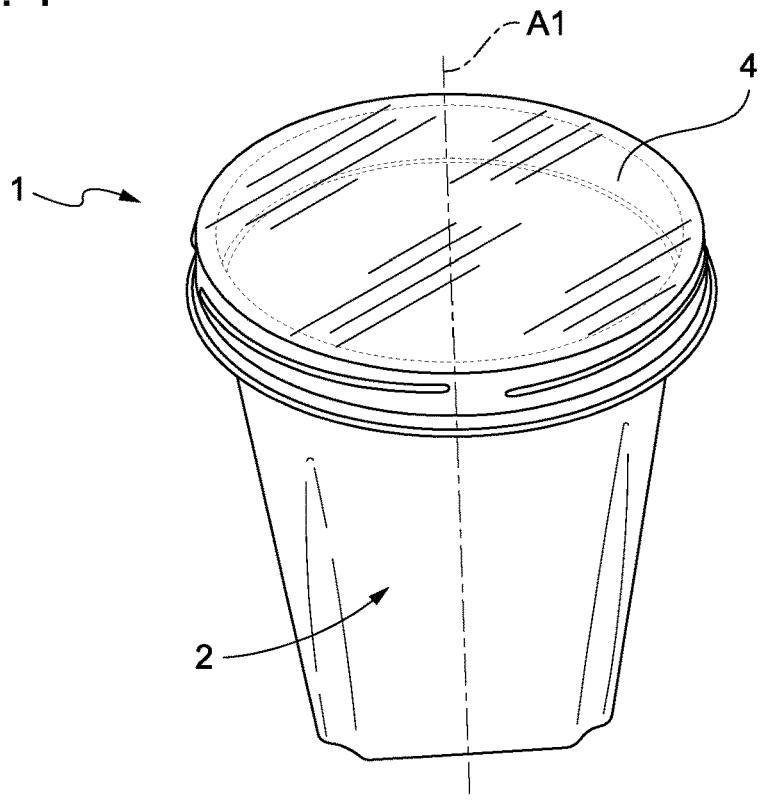

With reference to FIG. 1, number 1 indicates a container assembly 1 for sauce packaging as a whole. The container assembly 1 comprises a container 2 that extends along an axis A1; a lid 3; and a protective foil 4 (FIG. 2).

In particular, the lid 3 is coupled by screwing to the container 2 to allow the closure of the container 2.

The protective foil 4 (FIG. 2) is adhesively bonded to the mouth of container 2 to seal the container 2 and preserve the contents of container 2.

Figure 3:
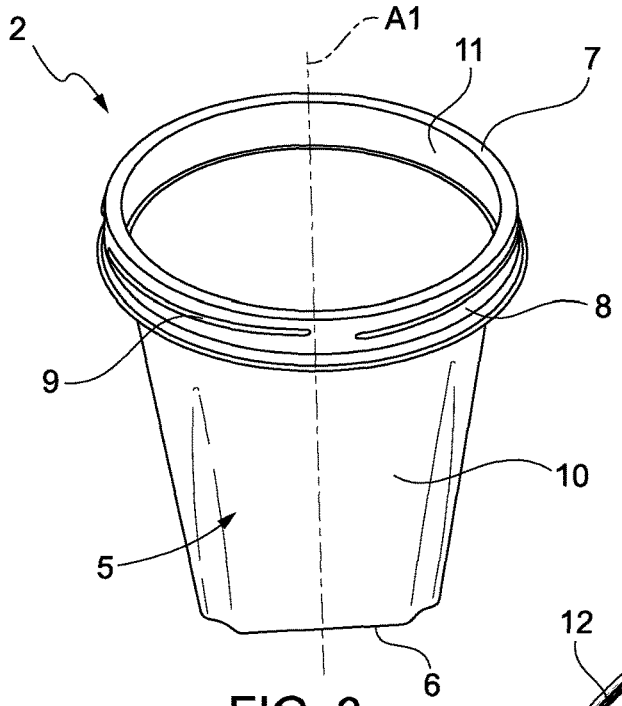
FIG. 3 is a perspective view, with parts removed for clarity, of a container for sauce packaging in accordance with the present invention.

With reference to FIG. 3, number 2 indicates, as a whole, a container 2 for sauce packaging. The container 2 extends along an axis A1 and comprises a side wall 5, a bottom wall 6 connected to one end of the side wall 5 to define a containment compartment, a top wall 7 configured for allowing the adhesion of a protective foil 4 to seal the container 2, and an outer cylindrical wall 8 that develops around side wall 5.

The outer cylindrical wall 8 has an outer face and comprises a thread 9 along the outer face for coupling with the lid 3 for closing the container 2.

The side wall 5 comprises a lower portion 10 flared and connected to the bottom wall 6, and an upper portion 11 connected to the outer cylindrical wall 8 through the top wall 7 in such a way as to define a gap between the outer cylindrical wall 8 and the side wall 5.

In particular, according to a preferred embodiment, the bottom wall 6 is a square-shaped flat wall with a concave connection at each corner.

The lower portion 10 extends from the bottom wall 6 to the upper portion 11, which, if cut with a plane parallel to the bottom wall 6, has a section in the shape of a circular crown.

Therefore, the lower portion 10 has different cross-sections with different shapes and/or sizes when cut with planes parallel to the bottom wall 6 at different distances from the bottom wall 6.

Figure 4:
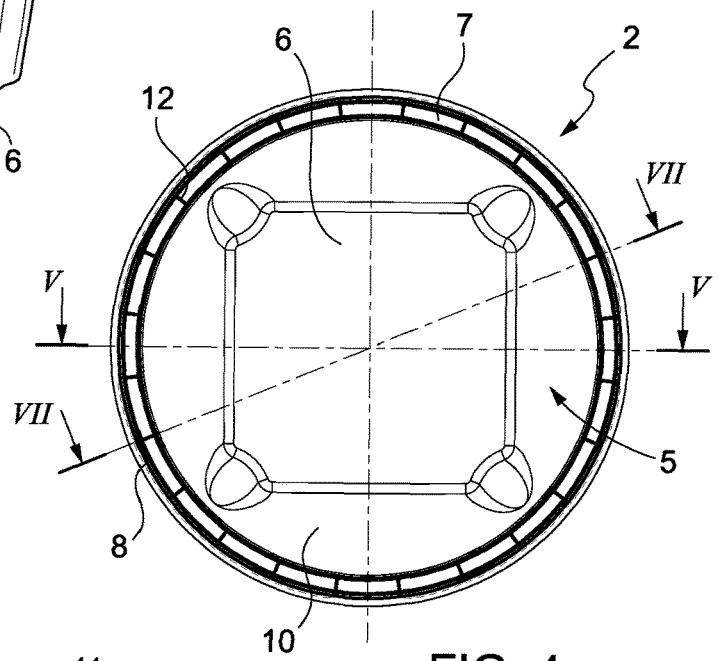
FIG. 4 is a bottom view of the container shown in FIG. 3.

With reference to FIG. 4, the container 2 comprises a plurality of connecting elements 12 between the upper portion 11 of the side wall 5 and the outer cylindrical wall 8. The connecting elements 12 are evenly distributed around the axis A1 along a circular crown within the gap between the outer cylindrical wall 8 and the upper portion 11 of the side wall 5, so as to stiffen the outer cylindrical wall 8.

Figure 5:
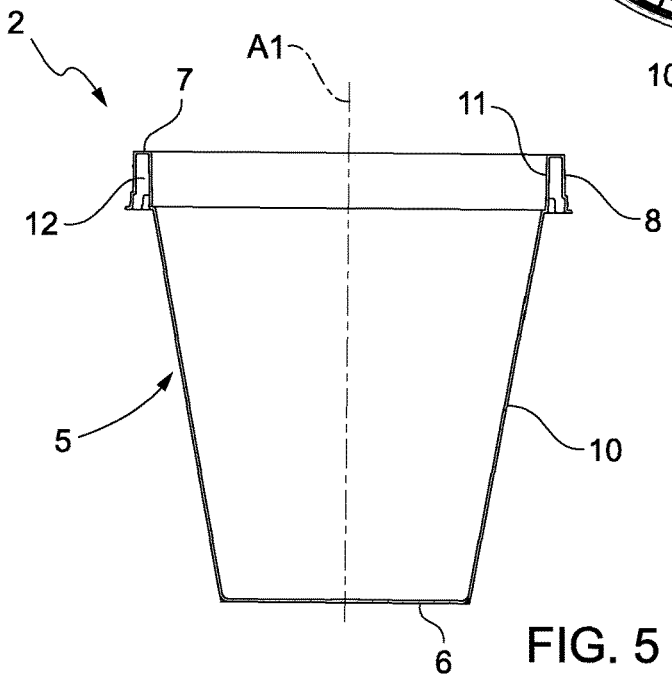
FIG. 5 is a cross-sectional view of the container in FIG. 3 along the V-V section lines.

With reference to FIG. 5, in a particular non-limiting embodiment of the present invention, the upper portion 11 is cylindrical. In this configuration, the upper portion 11 forms a shoulder with the lower portion 10 and each connecting element 12 extends to a plane identified by the shoulder.

Figure 6:
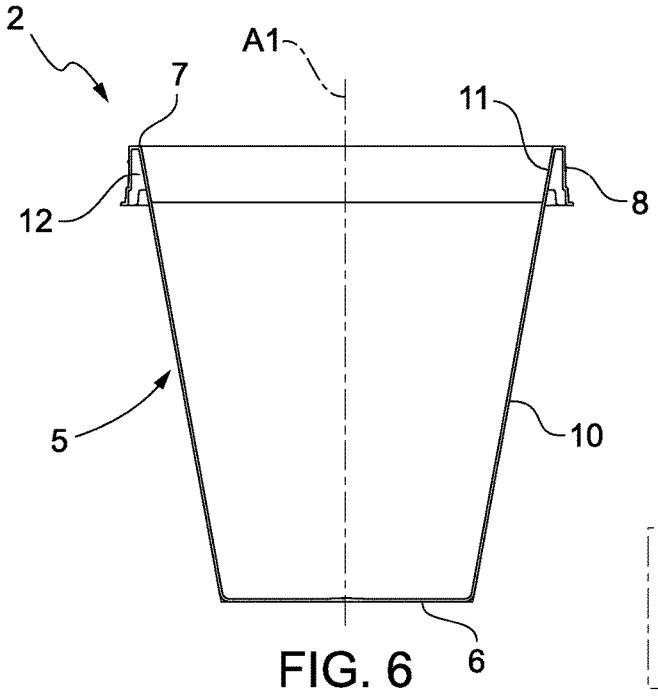
FIG. 6 is a cross-sectional view of a container in accordance with a second embodiment of the present invention.

With reference to FIG. 6, the upper portion 11 is flared and has the same inclination of the lower portion 10 with respect to the bottom wall 6, forming the extension of the lower portion 10.

Figure 7:
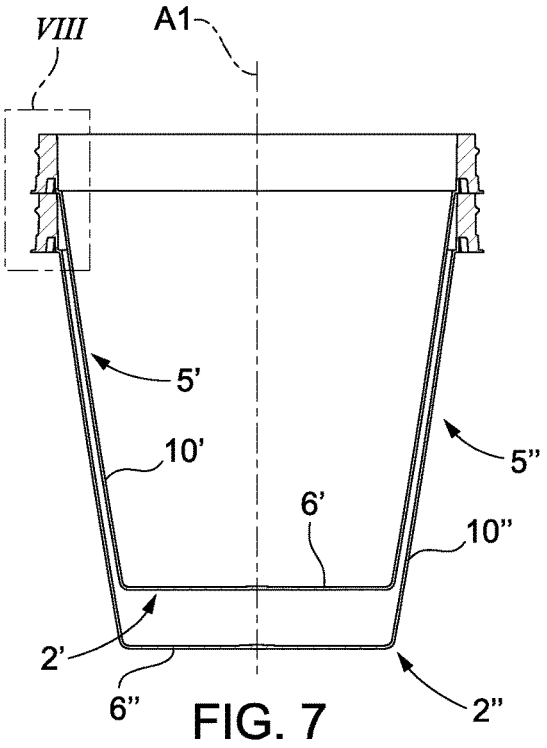
FIG. 7 is a cross-sectional view of two stacked containers.
Figure 8:
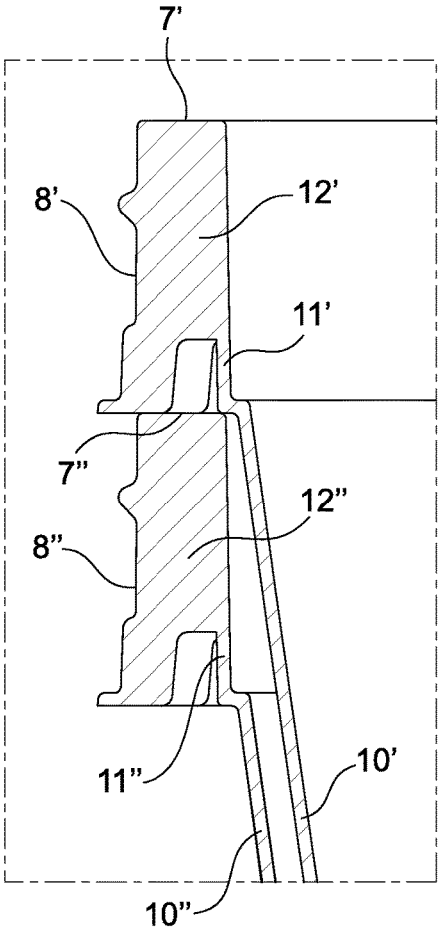
FIG. 8 is a detailed view of FIG. 7.

With reference to FIGS. 7 and 8, two stacked containers 2' and 2" are shown. In this configuration the upper portion 11' and the connecting elements 12' of the container 2' are in contact with the top wall 7" of the container 2", whilst the lower portion 10' of the container 2' is not in contact with the lower portion 10" of the container 2" and the bottom wall 6' of the container 2' is not in contact with the bottom wall 6" of the container 2".

It is apparent that variations can be made to the present invention without departing from the scope of the appended claims.

What is claimed is:

1. A container assembly comprising:

a container for sauce packaging, the container extending along an axis and comprising:

a side wall and a bottom wall connected to one end of the side wall to define a containment compartment;

a top wall configured for allowing the adhesion of a protective foil to seal the container;

an outer cylindrical wall that extends around the side wall and is configured to be coupled to a lid, the side wall comprising a lower portion flared and connected to the bottom wall and an upper portion connected to the outer cylindrical wall through the top wall;

a lid coupled to the outer cylindrical wall to close the container; and a protective foil adhesively bonded to the top wall;

wherein the top wall extends perpendicularly from the upper portion of the side wall.

2. The container assembly as claimed in claim 1, comprising a gap between the outer cylindrical wall and the side wall.

3. The container assembly as claimed in claim 1, wherein the upper portion is flared and constitutes an extension of the lower portion, the upper portion and the lower portion being coplanar.

4. The container assembly as claimed in claim 1, wherein the upper portion is cylindrical in shape.

5. The container assembly as claimed in claim 4, comprising a shoulder between the upper portion and the lower portion.

6. The container assembly as claimed in claim 1, comprising a plurality of connecting elements between the upper portion of the side wall and the outer cylindrical wall.

7. The container assembly as claimed in claim 6, wherein the connecting elements are evenly distributed around the axis between the outer cylindrical wall and the upper portion of the side wall.

8. The container assembly as claimed in claim 6, wherein each connecting element extends to a lower end of the outer cylindrical wall.

9. The container assembly as claimed in claim 1, wherein the outer cylindrical wall has an outer face and comprises a thread along the outer face for coupling with the lid.

10. The container assembly as claimed in claim 9, wherein the thread is configured to allow the closure of the container by means of a rotation of the lid for an angle lower or equal to 90°.

11. The container assembly as claimed in claim 1, wherein the top wall has a flat top face.

12. The container assembly as claimed in claim 1, wherein a minimum distance between the side wall and the outer cylindrical wall is at least 3 mm.

13. The container assembly as claimed in claim 1, wherein the bottom wall, the top wall, the outer cylindrical wall, the lower portion, and the upper portion are made of plastic material and the container is made by injection moulding.

14. The container assembly as claimed in claim 1, wherein the outer cylindrical wall extends from a first end which is coupled to the top wall to a free end, the outer cylindrical wall having a length measured from the first end to the free end, and wherein the outer cylindrical wall comprises a first vertical portion extending from the top wall to a shoulder and a second vertical portion extending from the shoulder to the free end, the first vertical portion comprising a greater share of the length of the outer cylindrical wall than the second vertical portion.

15. The container assembly as claimed in claim 1 further comprising a shoulder between the upper and lower portions of the side wall, and wherein the outer cylindrical wall extends from the top wall to a free end that is aligned with the shoulder along a plane perpendicular to the axis of the container.

16. A container assembly comprising:

a container for sauce packaging, the container extending along an axis and comprising:

a side wall and a bottom wall connected to one end of the side wall to define a containment compartment;

a top wall configured for allowing the adhesion of a protective foil to seal the container;

an outer cylindrical wall that extends around the side wall and is configured to be coupled to a lid, the side wall comprising a lower portion flared and connected to the bottom wall and an upper portion connected to the outer cylindrical wall through the top wall;

a lid coupled to the outer cylindrical wall to close the container;

a protective foil adhesively bonded to the top wall; and further comprising a shoulder between the upper and lower portions of the side wall, and wherein the outer cylindrical wall extends from the top wall to a free end that is aligned with the shoulder along a plane perpendicular to the axis of the container.

* * * * *